73-658 SR
5/30/78 OR 4,091,660

United States Patent [19]
Yanagi

[11] 4,091,660
[45] May 30, 1978

[54] APPARATUS FOR DETECTING THE BREAKING OF A GLASS PLATE

[75] Inventor: Masahiro Yanagi, Hirakata, Japan

[73] Assignee: Matsushita Electric Industrial Co., Ltd., Kadoma, Japan

[21] Appl. No.: 778,324

[22] Filed: Mar. 16, 1977

[51] Int. Cl.[2] ..... G08B 13/04
[52] U.S. Cl. ..... 73/658; 340/274 R
[58] Field of Search ..... 73/71.2, 71.4, 67, 69; 340/261, 274 R

[56] References Cited

U.S. PATENT DOCUMENTS 3,521,166 7/1970 Grayzel ..... 73/67 X

FOREIGN PATENT DOCUMENTS 1,402,530 8/1975 United Kingdom ..... 340/274 R
1,415,498 11/1975 United Kingdom ..... 340/274 R

*Primary Examiner*—James J. Gill
*Attorney, Agent, or Firm*—Wenderoth, Lind & Ponack

[57] ABSTRACT

The present invention is an apparatus for detecting the breaking of a glass plate. The invention uses a piezoelectric element, a signal separating circuit and a gate circuit. The piezoelectric element converts the vibrations of the glass plate into an electrical signal. The signal separation circuit separates the electrical signal into two signal signal components. The first signal component has a frequency range of less than 50 kHz. The second signal component has a frequency component higher than 100 kHz. The gate circuit produces an output signal only when both of the signal components have a signal level higher than their respective predetermined levels. By simultaneous detection of both of the first and second signal components, erroneous indication of the breaking of a glass plate can be prevented.

4 Claims, 4 Drawing Figures

APPARATUS FOR DETECTING THE BREAKING OF A GLASS PLATE

BACKGROUND OF THE INVENTION

This invention relates to an apparatus for detecting the breaking of a glass plate, and more particularly to such apparatus for detecting the vibration of a glass plate which occurs when the glass plate gets broken or damaged, so as to detect the breaking or damage of the glass plate.

It is known that when a glass plate having a piezoelectric element mounted thereon gets broken or damaged a mechanical vibration is produced. The electrical signal produced by the piezoelectric element due to mechanical vibration-to-electrical signal conversion has signal components not only in a low frequency range such as 20 to 30 kHz but also in a high frequency range higher than 100 kHz. Japanese laid-open patent publication (non-examined) NO. 48-66485/1973 based on British patent application No. 57598/71 discloses an apparatus which detects the breaking of a glass plate by detecting the converted electric signal with a frequency above 100 kHz only. According to the teaching of the above cited Japanese laid-open patent publication No. 48-66485/1973, the detection of signal components in a low frequency range lower than 100 kHz is avoided, so as to prevent erroneous detection of the breaking of the glass plate.

However, it has been found that signal components higher than 100 kHz appear at the output of the piezoelectric element not only when the glass plate gets broken but also when sand, a small stone, a small metal body or the like collides with the glass plate. This leads to an erroneous detection of the breaking of the glass plate

SUMMARY OF THE INVENTION

It is an object of this invention to provide an apparatus which detects the breaking of a glass plate without erroneous detection.

This object is achieved according to this invention by providing an apparatus for detecting the breaking of a glass plate, comprising: a piezoelectric element mounted on a glass plate for converting the mechanical vibration of the glass plate to an electrical signal; a signal separating circuit coupled to the piezoelectric element for separating the electrical signal into a first signal component corresponding to the electrical signal lower than 50 kHz and a second signal component higher than 100 kHz; and a gate circuit coupled to said signal separating circuit for receiving both of the first and second signal components and for producing an output signal only when both of the first and second signal components have signal levels higher than their respective predetermined levels.

The signal separating circuit can comprise: a low pass filter the cut-off frequency of which is not higher than 50 kHz; and a resonant circuit the resonant frequency of which is not lower than 100 kHz. The second signal component can be applied to the gate circuit as a gate control signal, and the gate circuit can prevent the first signal component from passing to the output of said low pass filter when the second signal component has a signal level lower than the predetermined level. The low pass filter can comprise a series connection of a resistor coupled to a terminal of the piezoelectric element and a capacitor coupled to the opposite terminal of the piezoelectric element. The resonant circuit can be coupled at an output terminal thereof to an input terminal of a rectifier circuit. The gate circuit can comprise a field effect transistor the gate of which is connected to an output terminal of the rectifier circuit, the drain of which is connected to the mid-point between the resistor and the capacitor of the low pass filter, and the source of which is coupled to the opposite terminal of the piezoelectric element. The rectifier circuit can be connected to the gate of the field effect transistor in such manner that when the second signal component has a signal level higher than the predetermined level, the rectifier circuit applies a negative bias to the gate of the field effect transistor to keep the field effect transistor in its OFF state.

BRIEF DESCRIPTION OF THE DRAWINGS

This and other objects and features of this invention will be described in detail hereinafter with referance to the accompanying drawings, in which.

DETAILED DESCRIPTION OF THE INVENTION

Figure 1:
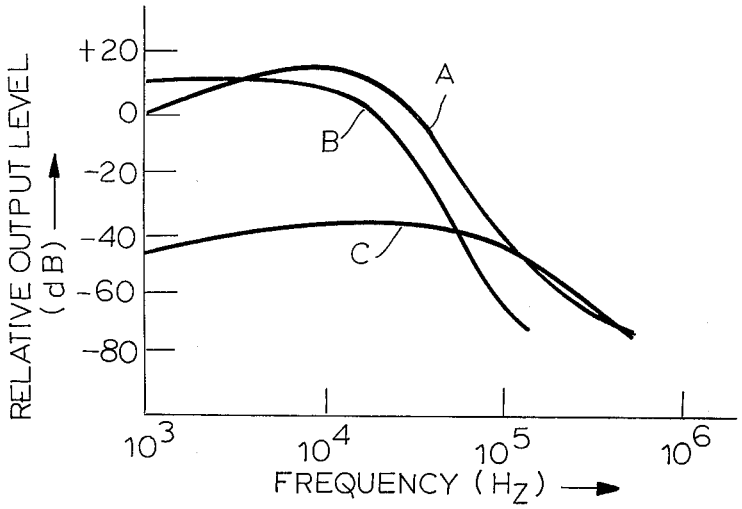
FIG. 1 is a graph showing the relation between relative levels of the output electrical signals of a piezoelectric element mounted on a glass plate upon mechanical vibrations of the glass plate and the frequency of the output electrical signals.

Referring to FIG. 1, curve A is an output spectrum of a piezoelectric element mounted on a glass plate, which spectrum appears upon the breaking of the glass plate. Curve B is an output spectrum of the piezoelectric element when the glass plate is struck with a high strength which is near but does not exceed the minimum strength to break or damage the glass plate. Curve C is an output spectrum of the piezoelectic element when sand or a small metal body (such as a metal wire segment) collides with the glass plate without breaking the glass plate. As apparent from FIG. 1, curve A is similar to curve B as to the signal level in a low frequency range and is similar to curve C as to the signal level in a high frequency range. Thus, is is very difficult to correctly detect the breaking of the glass plate by detecting a high frequency component only or a low frequency component only. According to the conventional technique which detects the breaking of the glass plate by detecting the existence of the high frequency component about 100 kHz (or by detecting whether the level of the high frequency component is higher than a predetermined level), erroneous detection of the breaking of the glass plate often occurs, especially when the sensitivity of the piezoelectric element to the mechanical vibration is increased.

This invention utilizes the characteristic relations between the three curves A,B and C of FIG. 1. That is, the collision of a sand or a small metal body with the glass plate without breaking the glass plates causes the piezoelectric element to produce a signal component similar to the signal component produced by the piezoelectric element upon the breaking of the glass plate as to the signal level in the high frequency range above 100 kHz, but the signal level produced due to the sand or the small metal body is much lower than the signal level produced due to the breaking of the glass plate in the case of the low frequnecy range below 50 kHz. Further, the signal level produced due to the strong striking of the glass plate without breaking the glass plate is similar to the signal level produced due to the breaking of the glass plate in the low frequency range below 50 kHz, but is much lower than the signal level produced due to the breaking of the glass plate in the high frequency range above 100 kHz. This invention achieves accurate detection of the breaking (and non-breaking) of the glass plate by using the characteristic signal curve produced upon the breaking of the glass plate. This curve is demarcated from the signal curves produced due to sand or a small metal body or strong striking of the glass plate when both the signal level in the low frequency range below 50 kHz and the signal level in the high frequency range above 100 kHz are compared.

More specifically, according to this invention, two separate signal components are separated out from the output signal of the piezoelelectric element. One of the two signal components is a first signal component which corresponds to the output signal of the piezoelectric element in the frequency below 50 kHz. The other signal component is a second signal component which corresponds to the output signal of the piezoelectric element in the frequency above 100 kHz. By producing a signal only when the signal levels of both of the first and second signal components are higher than predetermined levels, the breaking of the glass plate is detected.

The above described predetermined level for the first signal component is such level that falls within the level range between the levels of curves A and C of FIG. 1 in the frequency range below 50 kHz. Similarly, the predetermined level for the second signal component is such level that falls within the level range between the levels of curves A and B of FIG. 1 in the frequency range above 100 kHz.

Figure 2:
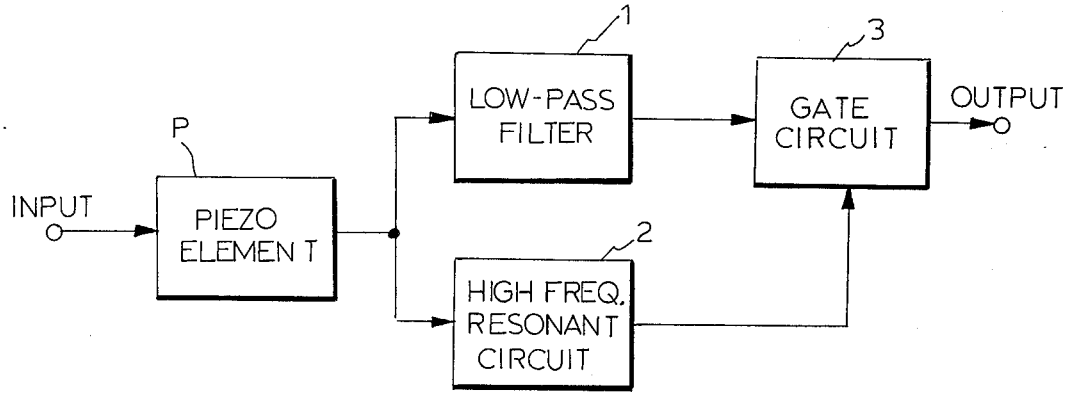
FIG. 2 is a schematic block diagram of an example of the apparatus of this invention.

An example of the apparatus of this invention is shown in FIG. 2. Referring to FIG. 2, reference character P designates a piezoelectric element mounted on a glass plate (not shown). The output terminal of the piezoelectric element is coupled to each of input terminals of a low pass filter 1 and a high frequency resonant circuit 2. The cut-off frequency of the filter 1 is 50 kHz or below 50 kHz so that it passes electric signals of frequencies below 50 kHz. The resonant frequency of the high frequency resonant circuit 2 is above 100 kHz so that it passes electric signals of a frequency above 100 kHz. Thus, the low pass filter 1 and the high frequency resonant circuit 2 forms a signal separating circuit for separating the output electric signal of the piezoelectric element P into a first signal component in a frequency range lower than 50 kHz and a second signal component in a frequency range higher than 100 kHz.

If desired, a high pass filter having a cut-off frequency 100 kHz or above 100 kHz can be used instead of the high frequency resonant circuit 2. The combination of the low pass filter 1 and such high pass filter also forms a signal separating circuit for separating the output signal of the piezoelectric element P into a first signal component in a frequency range lower than 50 kHz and a second signal component in a frequency range higher than 100 kHz.

The two output signals of the signal separating circuit (i.e. the output signal of the low pass filter 1 and the output signal of the high frequency resonant circuit 2 or the high pass filter) are applied to a gate circuit 3. One of the two output signals is an input signal to the gate circuit 3, and the other output signal is a gate control signal to the gate circuit 3. Conveniently, the output signal of the low pass filter 1 is used as the gate input signal, and the output signal of resonant circuit 2 is used as the gate control signal. The gate circuit 3 is so designed as to produce an output signal (detection signal) only when the levels of the two output signals of the signal separating circuit are above their respective predetermined levels. When the output signal of the piezoelectric element P can be represented e.g. by curve A of FIG. 1, the gate circuit produces the output signal, whereas when the output signal of the piezoelectric element can be represented e.g. by curve B or C of FIG. 1, the gate circuit does not produce the output signal. The above mentioned predetermined levels for the first and second signal components are such levels that fall within the level range between the levels of curves A and C of FIG. 1 in the frequency range below 50 kHz and within the level range between the levels of curves A and B of FIG. 1 in the frequency range above 100 kHz, respectively. Such predetermined levels, i.e. threshold levels for operating the gate circuit to discriminate the breaking and non-breaking of a glass plate can be easily set by selecting circuit elements used in the apparatus. According to the apparatus of this invention, the properties of the piezoelectric element is effectively utilized, and the detection circuit can be made simple. Further, no electrical power source is used in the detection circuit, so that noises which are likely to disturb the detection circuit when an electrical power source is used, do not occur, resulting in high performance of the detection circuit or apparatus.

Figure 3:
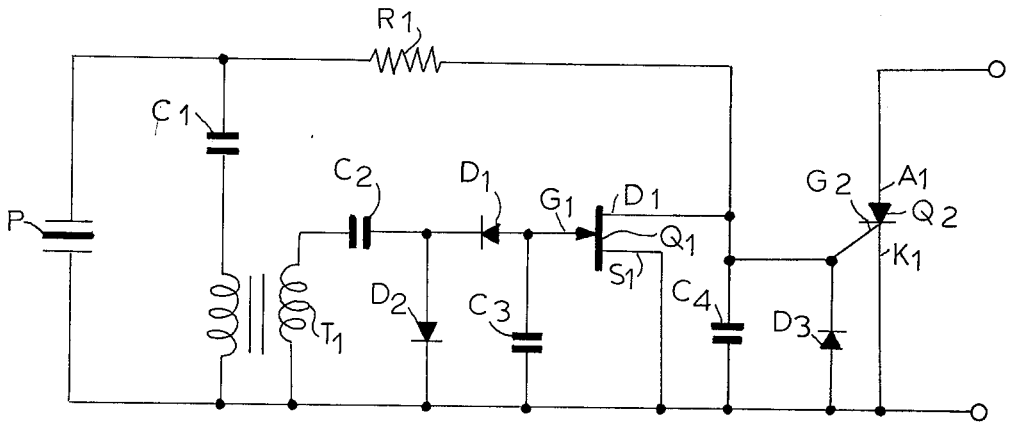
FIG. 3 is a circuit diagram of an example of the apparatus of this invention.

FIG. 3 shows an example of the apparatus of this invention illustrated in a circuit diagram. Referring to FIG. 3, reference character P designates a piezoelectric element made e.g. of a piezoelectric ceramic material mounted on a glass plate. A capacitor $C_1$ and a high frequency transformer $T_1$ forms a series resonant circuit coupled to the piezoelectric element P. Capacitors $C_2$ and $C_3$ and diodes $D_1$ and $D_2$ that are coupled to the secondary winding of the transformer $T_1$ form a rectifier circuit. The piezoelectric element P, the primary winding of the transformer $T_1$, the diode $D_2$ and the capacitor $C_3$ are connected, at one terminal of each thereof, to a common terminal (earth ground) as shown. A field effect transistor $Q_1$ (which will hereinafter be called FET for convenience sake), as a gate circuit, is provided. The gate $G_1$ of the FET $Q_1$ is coupled to the rectifier circuit as shown, and the source $S_1$ of the FET $Q_1$ is coupled to the common terminal (earth ground) as shown, so as to form a negative bias circuit. The drain $D_1$ of the FET $Q_1$ is coupled to the piezoelectric element via a resistor $R_1$ as shown, and is also coupled to the gate $G_2$ of a silicon control rectifier (SCR) $Q_2$ in parallel with a capacitor $C_4$ and a diode $D_3$ as shown. The capacitor $C_4$, the diode $D_3$ and the SCR $Q_2$ are connected, at one terminal of each thereof, to the common terminal (earth ground) as shown.

The shape and the material of the piezoelectric element P are preferably so selected that the piezoelectric element P has a low internal impedance in the high frequency range. This is because the piezoelectric element is included in the resonant circuit, and if the internal impedance of the piezoelectric element is lower, the Q value of the resonance can be made higher, so that the high frequency signal component can be distinguished more clearly from noise components. An example of a preferable piezoelectric element P is a disk type piezoelectric ceramic material (diameter of 20 mm, and thickness of 1 mm) made of $Pb(Mg_{1/3}Nb_{2/3})$—$PbTiO_3$—$PbZrO_3$ such as "PCM80" manufactured by Matsushita Electronic Components Co., Ltd., Japan ("PCM" being a trade name of Matsushita Electronic Components Co., Ltd.). The high frequency resonant circuit comprising the capacitor $C_1$ and the transformer $T_1$ has a resonant frequency above 100 kHz, for example 300 kHz. In describing the operation of the apparatus of FIG. 3 hereinbelow, the resonant frequency is assumed to be 300 kHz, i.e. in a narrow frequency band defined by lower and upper limit frequencies both of which are very close to 300 kHz. However, it is preferable that the resonant frequency resides in a broader frequency band defined by lower and upper limit frequencies not very close to the center frequency such as 300 kHz.

When the output signal of the piezoelectric element P contains a sufficiently high level component in the frequency range below 50 kHz but does not contain any signal component or a sufficiently high level signal component at or near 300 kHz(for example, when the output signal of the piezoelectric element has characteristics of curve B of FIG. 1), the low frequency signal component below 50 kHz which is rejected by the capacitor $C_1$ gets to the drain of the FET $Q_1$ via the resistor $R_1$. However, due to the lack of the 300 kHz band signal component, no effective voltage is applied to the gate $G_1$ of the FET $Q_1$, so that the FET $Q_1$ is then in its ON state. Therefore, substantially no voltage appears at the gate $G_2$ of the SCR $Q_2$.

On the other hand, when the output signal of the piezoelectric element P contains sufficiently high level components both in the frequency range below 50 kHz and at or near 300 kHz (for example, when the output signal of the piezoelectric element has characteristics of curve A of FIG. 1), the 300 kHz band signal component causes resonance at the primary winding of the high frequency transformer $T_1$, the resonated signal is boosted by the secondary winding of the transformer $T_1$, and is applied to the rectifier circuit, so that the gate $G_1$ of the FET $Q_1$ is supplied with a negative bias. So, the FET $Q_1$ is then in its OFF state. Therefore, the low frequency signal component below 50 kHz passes through the low pass filter having a cut-off frequency 50 (or below 50 kHz) and comprising the resistor $R_1$ and the capacitor $C_4$, and triggers gate $G_2$ of the SCR $Q_2$, so that the SCR $Q_2$ is brought to its ON state. By the change of the state of the SCR $Q_2$, the breaking of the glass plate can be detected.

In the above description, the word "sufficiently high level component" means a signal component having a level above a predetermined level which falls within the level range between the levels of curves A and C of FIG. 1 in the case of the frequency range below 50 kHz or within the level range between the levels of curves A and B of FIG. 1 in the case of the frequency range above 100 kHz, and which can be easily set by selecting the elements used in the circuit.

In the above described example, the circuit comprising the diode $D_3$ and the SCR $Q_2$ is merely an example of treatment of the output signal at the output terminal of the detection circuit. This output signal at the output terminal can be treated by any other suitable and conventional technique. In the above example, the capacitor $C_3$ functions to hold the high frequency signal component produced by the high frequency resonant circuit so as to enable proper operation of the detection circuit even if the arrival of the low frequency component at the drain $D_1$ of the FET $Q_1$ is delayed in comparison with the arrival of the high frequency component at the gate $G_1$ of FET $Q_1$. In the above example, the diode $D_3$ functions to quicken the change of the state of the SCR $Q_2$ from the OFF state to the ON state. That is, until the SCR $Q_2$ is brought to the ON state, the piezoelectric element is negatively biased by positive portions of the gate current if there is not provided such diode $D_3$. This negative bias decreases the level of the effective output signal of the piezoelectric element, so that the transient time required for the output signal of the piezoelectric element to get to the sufficient level to operate the detection circuit is lengthened.

In the above, the cut-off frequency of the low pass filter for extracting the low frequency (first signal) component is set at 50 kHz (or below 50 kHz). This frequency 50 kHz is an experimentally found upper limit frequency. That is, the cut-off frequency of the low pass filter should be set at 50 kHz or below 50 kHz so as to avoid erroneous detection of the breaking of the glass plate in view of the characteristic curves A, B and C of FIG. 1. Thus, a low pass filter having the cut-off frequency of 50 kHz can be used. However, it is apparent from FIG. 1 that the difference between the levels of curves A and C near 50 kHz is not very large, so that the cut-off frequency of the low pass filter is preferably not very close to 50 kHz. Similarly, it is experimentally found that lower limit of the cut-off frequency of the high pass filter or the resonant frequency of the resonant circuit for extracting the high frequency component (second signal component) should be 100 kHz so as to avoid erroneous detection of the breaking of the glass plate in view of the characteristic curves A, B and C of FIG. 1. Thus, a high pass filter having a cut-off frequency of 100 kHz or resonant circuit having a resonant frequency of 100 kHz can be used. However, it is apparent from FIG. A that the difference between the level of curve B and the level of curve A (or B) near 100 kHz is not so large as that at a higher frequency than 100 kHz, so that such cut-off frequency of the high pass filter or such resonant frequency is preferably not very close to 100 kHz.

Figure 4:
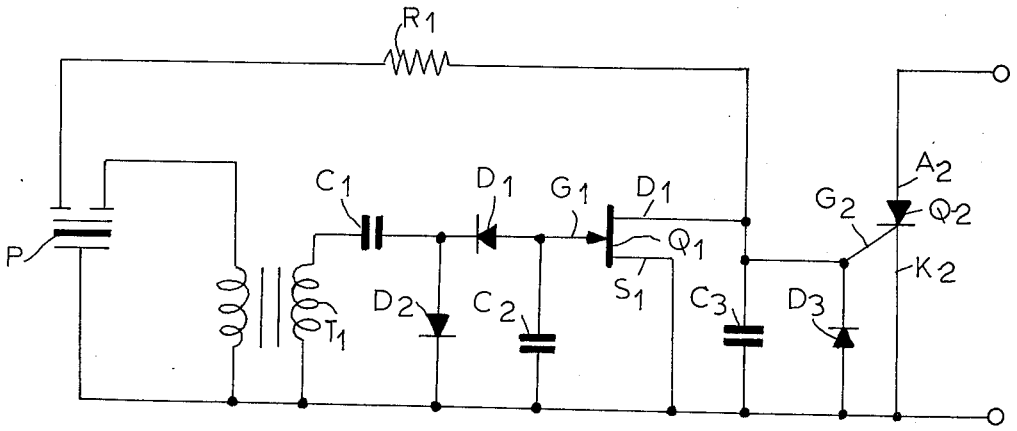
FIG. 4 is also a circuit diagram of an example of the apparatus of this invention.

FIG. 4 also shows an example of the apparatus of this invention illustrated in a circuit diagram. The apparatus of FIG. 4 is basically similar to the apparatus of FIG. 3, and thus like reference characters and numerals are used in both FIGS. 3 and 4 to designate like elements. According to FIG. 4, two electrodes are provided on the piezoelectric element P as shown. One is for the extraction of the low frequency component, and the other is for the extraction of the high frequency component. The electrode for the low frequency component is coupled to the drain $D_1$ of the FET $Q_1$ and the gate $G_2$ of the SCR $Q_2$ via the resistor $R_1$. The electrode for the high frequency component is coupled to the primary winding of the transformer $T_1$. In this case, the high frequency resonant frequency is determined by the capacitance of the piezoelectric element P and the inductance of the transformer $T_1$. The apparatus of FIG. 4 operates in a manner similar to the case of FIG. 3. Instead of using two electrodes on one surface of the piezoelectric element P, two piezoelectric elements each having only one electrode on one surface thereof can be used.

As evident from the foregoing description, the apparatus of this invention comprises a piezoelectric element for detecting a mechanical vibration on a glass plate and producing an electric signal, a signal separating circuit to separate the thus produced electric signal into a first signal component in a frequency range below 50 kHz and a second signal component above 100 kHz, and signal processing (gate) circuit coupled to the output terminals of the signal separating circuit for passing therethrough and producing a signal only when both output signals corresponding to the first and second signal components appear at the output terminals of the signal processing (gate) circuit (or more specifically, only when both output signals at the output terminals of the gate circuit have signal levels higher than their respective predetermined levels). This apparatus operates to produce an output signal or detection signal (or glass break indication signal) when the glass plate on which the piezoelectric element is mounted gets broken, but does not produce such signal when sand or a small metal body collides with the glass plate without breaking the glass plate, or when the glass plate is struck without being broken.

So, this apparatus can effectively be adapted to an alarm apparatus for producing an alarm signal upon the breaking of a glass plate so as to protect, for example, goods in a glass case in a shop from being taken by robbers who break the glass case. The apparatus of this invention can effectively be used for other purposes also.

What is claimed is:

1. An apparatus for detecting the breaking of a glass plate, comprising: a piezoelectric element mounted on a glass plate for converting vibrations of said glass plate to an electrical signal; a signal separating circuit coupled to said piezoelectric element for separating said electrical signal into a first signal component corresponding to said electrical signal lower than 50 kHz and a second signal component corresponding to said electrical signal higher than 100 kHz; and a gate circuit coupled to said signal separating circuit for receiving both of said first and second signal components and for producing an output signal only when both of said first and second signal components have signal levels higher than their respective predetermined levels.

2. An apparatus according to claim 1, wherein said signal separating circuit comprises: a low pass filter the cut-off frequency of which is not higher than 50 kHz; and a resonant circuit the resonant frequency of which is not lower than 100 kHz.

3. An apparatus according to claim 2 wherein said second signal component is applied to said gate circuit as a gate control signal, and said gate circuit prevents said first signal component from passing to the output of said low pass filter when said second signal component has a signal level lower than the predetermined level.

4. An apparatus according to claim 2, wherein said low pass filter comprises a series connection of a resistor coupled to a terminal of said piezoelectric element and a capacitor coupled to the opposite terminal of said piezoelectric element; said resonant circuit is coupled at an output terminal thereof to an input terminal of a rectifier circuit; and said gate circuit comprises a field effect transistor the gate of which is connected to an output terminal of said rectifier circuit, and the drain of which is connected to the mid-point between said resistor and said capacitor of said low pass filter, and the source of which is coupled to said opposite terminal of said piezoelectric element, said rectifier circuit being connected to said gate of said field effect transistor in such manner that when said second signal component has a signal level higher than the predetermined level, said rectifier circuit applies a negative bias to said gate of said field effect transistor to keep said field effect transistor in its OFF state.

* * * * *